United States Patent [19]

Clark, Jr.

[11] Patent Number: 4,537,037

[45] Date of Patent: Aug. 27, 1985

[54] THERMALLY POWERED HEAT TRANSFER SYSTEMS UTILIZING SEQUENTIAL DISPLACEMENT

[76] Inventor: Robert W. Clark, Jr., 2232 W. Joan de Arc Ave., Phoenix, Ariz. 85029

[21] Appl. No.: 666,742

[22] Filed: Oct. 31, 1984

[51] Int. Cl.[3] ..... F25B 1/00

[52] U.S. Cl. ..... 62/116; 62/467

[58] Field of Search ..... 62/116, 467, 333, 335

[56] References Cited

U.S. PATENT DOCUMENTS

| | | | |
|---|---|---|---|
| 3,699,779 | 10/1972 | Schlichtig | 62/467 |
| 3,763,663 | 10/1973 | Schlichtig | 62/467 |
| 4,120,172 | 10/1978 | Pierce | 62/467 |
| 4,418,547 | 12/1983 | Clark, Jr. | 62/467 |
| 4,450,690 | 5/1984 | Clark, Jr. | 62/467 |

*Primary Examiner*—Ronald C. Capossela

*Attorney, Agent, or Firm*—Edward W. Hughes

[57] ABSTRACT

A thermally powered heat transfer system which sequentially displaces thermal energy from the highest temperature heat source through two or more high temperature heat transfer loops to a heat sink. The system includes two or more two chamber compressors, with the high temperature chamber of each compressor being included in a high temperature heat transfer loop, there being a high temperature heat transfer loop for each compressor. The low temperature chamber of each compressor is included in one or more low temperature heat transfer loops. The source of heat for the evaporator heat exchanger of each high temperature heat transfer loop except one being heat from the condenser heat exchanger of another high temperature loop. The heat exchangers for the low temperature heat transfer loops being interchangeable depending on the mode of operation at any given time.

15 Claims, 3 Drawing Figures

THERMALLY POWERED HEAT TRANSFER SYSTEMS UTILIZING SEQUENTIAL DISPLACEMENT

BACKGROUND OF THE INVENTION

1. Field of the Invention

This invention is in the field of thermally powered heat transfer systems. This invention relates more particularly to refrigeration systems which use heat to cool a structure. This invention relates as well to thermally powered heat pump systems which employ heat from a primary heat source to acquire heat from a second lower temperature heat source, the heat from both heat sources being used to heat a structure. The design of this invention is such that in one mode of operation it may be used to cool a structure and in its second mode of operation used to heat a structure.

This invention is specifically a significant improvement upon U.S. Pat. No. 4,418,547 issued to the inventor of this invention Dec. 6, 1983. This significant improvement results from the use of a new general method, sequential displacement, for using heat to accomplish the cooling or the efficent heating of a structure.

2. Description of the Prior Art

The thermally powered heat transfer system described in U.S. Pat. No. 4,418,547 issued Dec. 6, 1983 employs a compressor which acts with positive compressive action in both of two possible compressive action directions; employs two heat sources to effect these compressive actions, one of these heat sources being located within the structure to be cooled when the system is used for cooling; employs two closed loops containing two different refrigerants, and employs two condensers both of which reject heat to an external heat sink when the system is used for cooling, the external heat sink having a temperature below that of the high temperature heat source and above that of the low temperature heat source. The thermally powered heat transfer system described in U.S. Pat. No. 4,418,547 permits the higher temperature heat source to have a relatively low temperature in comparison to the temperature required for the operation of other thermally powered refrigeration systems to accomplish the cooling of a structure.

SUMMARY OF THE INVENTION

The present invention provides a thermally powered heat transfer system particularly adapted to the efficient cooling or heating of a home or other structure when a higher temperature heat source than that required for the operation of the system described in U.S. Pat. No. 4,418,547 is available. The present invention employs a new general method, sequential displacement, along with this higher temperature heat source, to substantially improve the thermal efficiency of the heat transfer process. This invention employs two or more compressors each of which act with positive compressive action in both of two possible compressive action directions as described in U.S. Pat. No. 4,418,547, employs three or more closed loops and three or more different refrigerants, employs three or more evaporators of which at least one is located within the structure to be cooled when the system is used for cooling; and employs three or more condensers only a lesser number of which transfer heat to a heat sink external to the structure being cooled when the system is used for cooling. At least one of the condensers transfers heat to at least one of the evaporators at a temperature lower than that of the original heat source but at a temperature above that of the external heat sink when the system is used for cooling. The different refrigerants which fill each closed loop are selected on the basis of their thermodynamic properties in relation to each other and on the basis of system design parameters so that the vapor formed in the evaporator of each of the two heat transfer loops respectively connected to the two chambers of a given compressor can act with positive compressive force upon the vaporized refrigerant in the other chamber when the vaporized refrigerant being compressed is permitted to flow into the condenser of its heat transfer loop. Sequential displacement permits the heat from the initial heat source to be used directly in the first compressor and to be reused; i.e., to be the source of heat for the evaporator of the third heat transfer loop at a lower but sufficient temperature to effect more efficient heat transfer than is possible using the thermally powered heat transfer system described in U.S. Pat. No. 4,418,547.

It is therefore an object of this invention to provide a thermally powered heat transfer system useful for the cooling of homes and other structures.

It is still another object of this invention to provide a thermally powered heat transfer system useful for the heating of homes and other structures, such usefulness being the result of adding heat from a secondary external heat source to the heat from the fuel or other primary heat source used for heating the home or other structure.

It is still another object of this invention to provide a new general method, sequential displacement, for the design of efficient thermally powered heat transfer systems useful for the cooling and heating of homes and other structures.

It is still another object of this invention to provide a thermally powered heat transfer system which can be operated at low purchased energy cost to alternately cool a home or other structure during the summer and to heat a home or other structure during the winter.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENT

Figure 1:
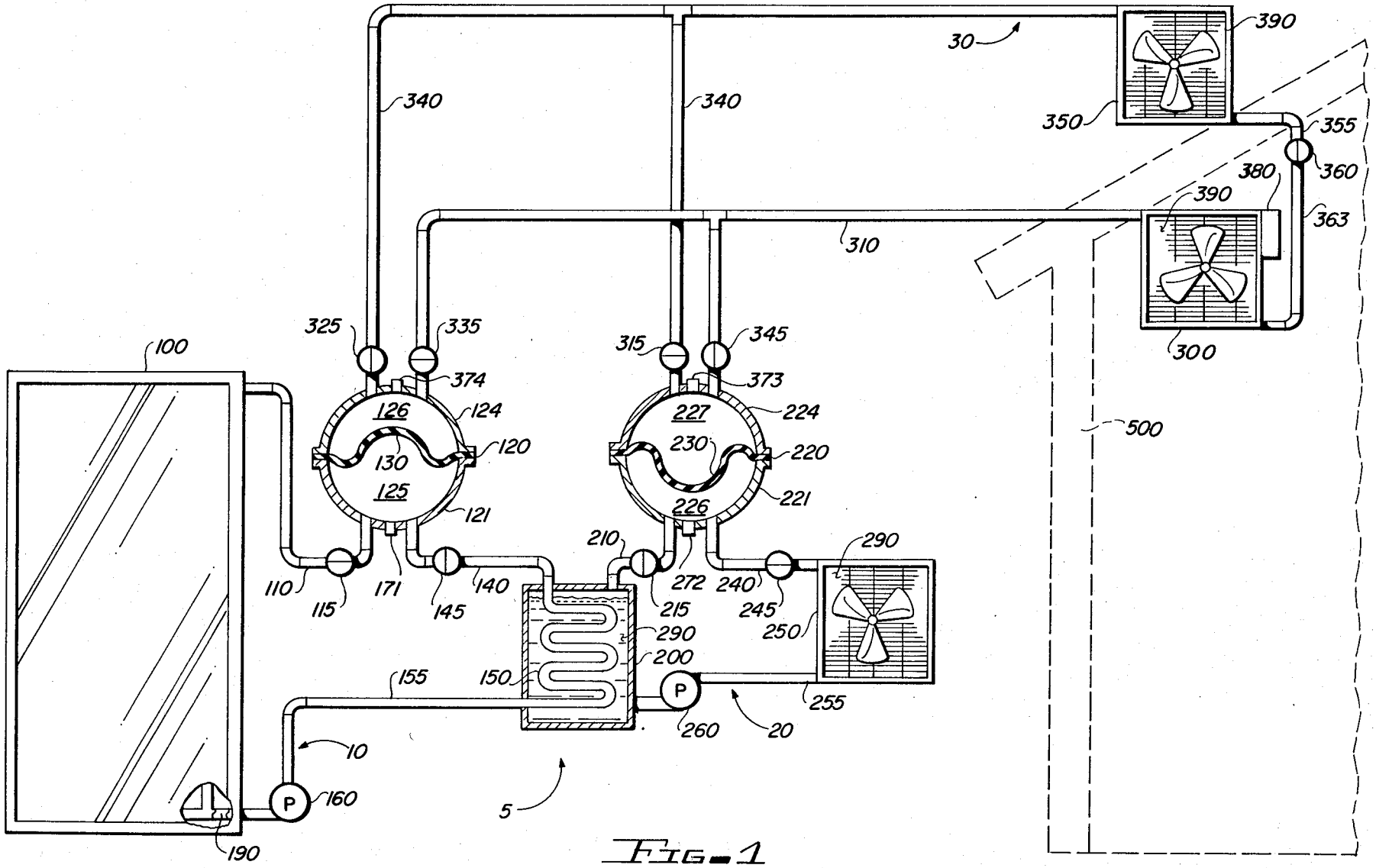
FIG. 1 is a schematic view of a preferred embodiment of the thermally powered heat transfer system employed to remove heat from a single structure embodying this invention and employing sequential displacement.

The thermally powered heat transfer system 5 depicted in FIG. 1 consists of three closed heat transfer loops, higher temperature loops 10, 20, and lower temperature loop 30, each of which contains a different refrigerant in both liquid and vapor states. Closed heat transfer loop 10 consists of an evaporator, 100, located so as to acquire heat from an external heat source or from the burning of a fuel, said evaporator 100 being depicted in FIG. 1 as a solar collector deriving heat from solar energy. The top of evaporator 100 is connected by means of refrigerant vapor pipe 110 to the bottom chamber 125 of spherically shaped compressor 120. Vapor flow through refrigerant vapor pipe 110 is regulated by electrically activated valve 115. Compressor 120 consists of two rigid hemispheres, 121 and 124, joined together with a flexible shaped diaphragm, 130, between them. Shaped diaphragm 130 is constructed of suitable flexible and impervious material such as a nylon fabric coated with neoprene or with a flexible epoxy, and is shaped so as to fit against the inner wall of hemisphere 121 or hemisphere 124 and moves from one position to the other in response to the vapor pressures exerted upon it. Thus compressor 120 is divided by diaphragm 130 into two chambers 125 and 126 of variable size with chamber 125 being designated as the higher temperature chamber and chamber 126 as the lower temperature chamber. The bottom chamber 125 of compressor 120 is connected to the bottom of evaporator 100 by means of refrigerant vapor pipe 140 which feeds into condenser coil 150 which in turn feeds into refrigerant liquid pipe 155. Condenser coil 150 is contained within evaporator 200 of high temperature heat transfer loop 20. Refrigerant flow from compressor 120 to the bottom of evaporator 100 is regulated by electrically activated valve 145 and liquid pump 160. Evaporator 100, a portion of condenser coil 150 and refrigerant liquid pipe 155 are filled with liquid refrigerant 190, the balance of closed heat transfer loop 10 being filled with refrigerant 190 vapor.

Closed heat transfer loop 20 consists of evaporator 200 within which condenser coil 150 of closed heat transfer loop 10 is enclosed, said condenser 150 serving as the heat source for closed heat transfer loop 20. The top of evaporator 200 is connected by means of refrigerant vapor pipe 210 to the bottom, or high temperature, chamber 226 of compressor 220. Vapor flow through refrigerant vapor pipe 210 is regulated by electrically activated valve 215. Compressor 220 consists of two rigid hemispheres, 221 and 224, joined together with a flexible shaped diaphragm 230, between them. Shaped diaphragm 230 is shaped so as to fit against the inner wall of hemisphere 221 or hemisphere 224 and moves from one position to the other in response to the vapor pressures exerted upon it. Thus compressor sphere 220 is divided by diaphragm 230 into two chambers 226,227 of variable size. The bottom chamber 226 of compressor 220,its high temperature chamber, is connected to the heat exchanger-condenser 250 by means of refrigerant vapor pipe 240. Flow through refrigerant vapor pipe 240 is regulated by electrically activated valve 245. Heat exchanger-condenser 250 is depicted in FIG. 1 as using fan driven external air as the heat sink but other heat sinks and alternatively designed condensers may be utilized without departing from the spirit of the invention as defined by the scope of the claims. The bottom of condenser 250 is connected to the bottom of evaporator 200 by means of refrigerant liquid pipe 255. Flow through refrigerant liquid pipe 255 is regulated by refrigerant liquid pump 260. Evaporator 200, a portion of condenser 250 and refrigerant liquid pipe.255 are filled with liquid refrigerant 290, the balance of high temperature closed heat transfer loop 20 being filled with refrigerant 290 vapor.

Low temperature closed heat transfer loop 30 consists of heat exchanger 300 which serves as the evaporator for closed heat transfer loop 30 when the heat transfer system 5 is used for cooling as depicted in FIG. 1. Evaporator-heat exchanger 300 is located within structure 500 to be cooled and is depicted in FIG. 1 as using fan driven air within structure 500 as the heat source for closed heat transfer loop 30 but alternate designs and other means may be used to effect the cooling of structure 500 without departing from the spirit of the invention as defined by the scope of the claims. The top of evaporator 300 is connected by means of refrigerant vapor pipe 310 to the upper, low temperature chamber 227 of compressor 220 and to the upper,low temperature chamber 126 of compressor 120, vapor flow into the upper chamber 227 of compressor 220 being regulated by electrically activated valve 345 and vapor flow into upper chamber 126 of compressor 120 being regulated by electrically activated valve 335. The upper chambers 227, 126 of compressors 220 and 120 are connected to the top of heat exchanger-condenser 350 by means of refrigerant vapor pipe 340, vapor flow from the upper chamber 227 of compressor 220 being regulated by electrically activated valve 315 and vapor flow from compressor 120 being regulated by electrically activated valve 325. Heat exchanger-condenser 350 is depicted as using fan driven external, or ambient, air as the heat sink for closed heat transfer loop 30 but other heat sinks and alternatively designed condensers may be utilized without departing from the spirit of the invention as defined by the scope of the claims. The bottom of condenser 350 is connected to the bottom of evaporator 300 by means of refrigerant liquid pipe 355 and refrigerant liquid tube 363. The diameter of tube 363 is made sufficiently small to provide the desired degree of pressure drop to maintain the required difference between the pressures within condenser 350 and evaporator 300. Alternatively the pressure difference can be achieved using a conventional pressure reducing valve. Liquid refrigerant flow from condenser 350 to evaporator 300 is regulated by electrically activated valve 360. Evaporator 300, a portion of condenser 350, refrigerant liquid pipe 355 and refrigerant liquid tube 363 are filled with liquid refrigerant 390, the balance of heat transfer loop 30 being filled with refrigerant 390 vapor.

Switch 171 is located at the bottom of compressor 120 and switch 171 is activated when diaphragm 130 is forced by vapor pressure against rigid hemisphere 121. When activated,switch 171 causes electrically activated valves 115 and 325 to open and electrically activated valves 145 and 335 to close. Switch 374 is located at the top of compressor 120 and switch 374 is activated when diaphragm 130 is forced by vapor pressure against rigid hemisphere 124. When activated switch 374 causes electrically activated valves 115 and 325 to close and electrically activated valves 145 and 335 to open. Switch 374 also activates pump 160, said pump being deactivated when switch 171 is activated.

Switch 272 is located at the bottom of compressor 220 and switch 272 is activated when diaphragm 230 is forced by vapor pressure against rigid hemisphere 221. When activated,switch 272 causes electrically activated valves 215 and 315 to open and electrically activated valves 245 and 345 to close. Switch 373 is located at the top of compressor 220 and switch 373 is activated when shaped diaphragm 230 is forced by vapor pressure against rigid hemisphere 224. When activated,switch 373 causes electrically activated valves 215 and 315 to close and electrically activated valves 245 and 345 to open. Switch 373 also activates pump 260, said pump being deactivated when switch 272 is activated.

Switch 380 is a liquid level control switch which monitors the level of liquid refrigerant 390 in evaporator 300. When the level of liquid refrigerant 390 reaches the top of evaporator 300 switch 380 causes electrically activated valve 360 to close. When the liquid level of refrigerant 390 in evaporator 300 falls below a minimum level, switch 380 causes electrically activated valve 360 to open.

Refrigerant 190 is selected so that its vapor pressure in evaporator 100 at operating temperature is greater than the vapor pressure of refrigerant 390 in condenser 350 and also so that refrigerant 190 vapor pressure in condenser 150 is less than the vapor pressure of refrigerant 390 in evaporator 300.

Refrigerant 290 is selected so that its vapor pressure in evaporator 200 is greater than the vapor pressure of refrigerant 390 in condenser 350 and also so that refrigerant 290 vapor pressure in condenser 250 is less than the vapor pressure of refrigerant 390 in evaporator 300.

Refrigerant 390 is selected so as to have the above cited relationships with refrigerants 190 and 290 and so as to meet over all system performance criteria for the cooling of a home or other structure.

To illustrate the operation of this invention, let us now assume that the refrigerant 190 with which closed loop 10 is filled is refrigerant R114, $CCl_2F_2$–$CCl_2F_2$ which has a boiling point at atmospheric pressure of 38.78° F., assume that the refrigerant 290 with which closed loop 20 is filled is refrigerant R12, $CCl_2F_2$, which has a boiling point at atmospheric pressure of −21.62° F., and assume that the refrigerant 390 with which closed loop 30 is filled is refrigerant R502, $CHClF_2/CClF_2CF_3$ (48.8/51.2% by weight), which has a boiling point at atmospheric pressure of −49.76° F. The choice of these specific refrigerantsis for illustration purposes and other refrigerants can be selected without departing from the spirit of the invention as defined by the scope of the claims.

Let us also assume that the internal condensing temperature within condenser 250 and within condenser 350 is 80° F. At a temperature of 80° F. refrigerant 290 (R12) has a vapor pressure of 98.87 PSIA and refrigerant 390 has a vapor pressure of 175.92 PSIA. Refrigerant 290 (R12) at a temperature of 122° F. has a vapor pressure of 176.85 PSIA and thus at any temperature of 122° F. or higher has a vapor pressure greater than that of refrigerant 390 (R502) at 80° F. At a temperature of 43° F. refrigerant 390 (R502) has a vapor pressure of 100.08 PSIA and thus at a temperature of 43° F. or higher refrigerant 390 has a vapor pressure greater than that of refrigerant 290(R12) at 80° F. Refrigerant 190(R114) at a temperature of 199° F. has a vapor pressure of 176.39 PSIA and thus at any temperature of 199° F. or higher has a vapor pressure greater than that of refrigerant 390 (R502) at 80° F. At a temperature of 153° F. refrigerant 190 (R114) has a vapor pressure of 99.99 PSIA and thus at any temperature of 153° F. or lower refrigerant 190 (R114) has a vapor pressure less than the vapor pressure of refrigerant 390 (R502) at any temperature of 43° F. or higher.

Given these physical characteristics of the three refrigerants let us assume that the liquid refrigerant 190 (R114) in evaporator 100 of closed loop 10 is heated by solar energy to a temperature in excess of 199° F. and thus has a vapor pressure in excess of 176.39 PSIA. At this temperature and pressure refrigerant 190 (R114) will boil and vapor will flow through refrigerant vapor pipe 110 and through open valve 115 into lower high temperature chamber 125 of compressor 120. The pressure exerted by refrigerant 190 (R114) will push diaphragm 130 and thereby cause diaphragm 130 to force refrigerant 390 (R502) vapor out of the upper, or lower temperature chamber 126 of compressor 120 through refrigerant vapor pipe 340 and open valve 325 into condenser 350 where it will condense at a temperature of 80° when the pressure within condenser 350 is at 175.92 PSIA. When refrigerant 190 (R114) fills lower chamber 125 of compressor 120, at which point all of the refrigerant 390 (R502) will have been forced out of upper chamber 126 of compressor 120, diaphragm 130 will push against the inner surface of rigid hemisphere 124 and will activate switch 374. Switch 374 will cause electrically activated valves 115 and 325 to close, will cause the previously closed valves 145 and 335 to open, and will activate pump 160.

At a temperature of 43° F. or higher liquid refrigerant 390 (R502) in evaporator 300 has a higher vapor pressure than that of refrigerant 190 (R114) in condenser 150 at a temperature of 153° F. and any lower temperature. Heat acquired from air circulating through evaporator 300 causes liquid refrigerant 390 (R502) to boil and refrigerant 390 (R502) vapor to flow through refrigerant vapor pipe 310 and open valve 335 into upper chamber 126 of compressor 120. The pressure exerted by refrigerant 390 (R502) cause diaphragm 130 to force refrigerant 190 (R114) vapor out of the lower chamber 125 of compressor 120 through refrigerant vapor pipe 140 and open valve 145 into condenser 150 where it will condense into a liquid at a temperature of 153° F. or at any lower temperature. The liquid refrigerant 190 formed in condenser 150 will flow into liquid refrigerant pipe 155 where it will be pumped by pump 160 into the bottom of evaporator 100. When refrigerant 390 (R502) fills the upper chamber 126 of compressor 120, at which point all of refrigerant 190 (R114) will have been forced out of lower chamber 125 of compressor 120, diaphragm 130 will push against the inner surface of rigid hemisphere 121 and will activate switch 171. Switch 171 will cause electrically activated valves 115 and 325 to open, will cause electrically activated valves 145 and 335 to close, and will turn off pump 160. This sets the stage for repeating the cycle.

During this cycle when the liquid level of refrigerant 390 in evaporator 300 falls below a given minimum, liquid level control switch 380 is activated and causes electrically activated valve 360 to open, thereby allowing liquid refrigerant 390 to flow from condenser 350 through refrigerant liquid pipe 355, open valve 360 and liquid tube 363 into the bottom of evaporator 300. When evaporator 300 is refilled, switch 380 is activated again and closes valve 360.

The heat given off by the condensation of refrigerant 190 (R114) in condenser 150 at a temperature of 153° F.

or any lower temperature is transfered to liquid refrigerant 290 (R12) in evaporator 200. This heat causes refrigerant 290 (R12) in evaporator 200 to boil at a temperature of 122° F. or higher, at which temperature the vapor pressure of the refrigerant 290 (R12) will exceed the vapor pressure of refrigerant 390 (R502) in condenser 350. Thus refrigerant 290 (R12) vapor will flow from evaporator 200 through refrigerant vapor pipe 210 and open valve 215 into lower chamber 226 of compressor 220. The pressure exerted by refrigerant 290 (R12) will push diaphragm 230 and thereby cause diaphragm 230 to force refrigerant 390 (R502) out of upper chamber 227 of compressor 220 through refrigerant vapor pipe 340 and open valve 315 into condenser 350 where it will condense at a temperature of 80° F. when its pressure is at 175.92 PSIA. When refrigerant 290 (R12) vapor fills lower chamber 226 of compressor 220, at which point all of the refrigerant 390 (R502) will have been forced out of upper chamber 227 of compressor 220, diaphragm 230 will push against the inner surface of rigid hemisphere 224 and will activate switch 373. Switch 373 will cause electrically activated valves 215 and 315 to close and the previously closed electrically activated valves 245 and 345 to open. Switch 373 will also at this time activate pump 260.

At a temperature of 43° F. or higher liquid refrigerant 390 (R502) in evaporator 300 has a higher vapor pressure than the vapor pressure of refrigerant 290 (R12) in condenser 250 at a temperature of 80° F. Heat acquired from air circulating through evaporator 300 causes liquid refrigerant 390 (R502) to boil and refrigerant 390 (R502) vapor to flow through refrigerant vapor pipe 310 and open valve 345 into upper chamber 227 of compressor 220. The pressure exerted by refrigerant 390 (R502) will cause diaphragm 230 to force refrigerant 290 (R12) vapor out of lower chamber 226 of compressor 220 through refrigerant vapor pipe 240 and through open valve 245 into condenser 250 where it will condense into a liquid at a temperature of 80° F. when its vapor pressure is 98.87 PSIA or higher. Liquid refrigerant 290 (R12) formed in condenser 250 will flow into liquid refrigerant pipe 255 where it will be pumped by pump of 260 into the bottom of evaporator 200. When refrigerant 390 (R502) fills upper chamber 227 of compressor 220, at which point all of refrigerant 290 (R12) will have been forced out of lower chamber 226 of compressor 220, diaphragm 230 will push against the inner surface of rigid hemisphere 221 and will activate switch 272. Switch 272 will cause electrically activated valves 215 and 315 to open, will cause electrically activated valves 245 and 345 to close, and will turn off pump 260. This sets the stage for repeating the cycle.

During the operation of both compressors heat is removed from the air circulating through evaporator 300 and the home or other structure is cooled thereby. This heat is rejected to outdoor, or ambient,air forced through condenser 350. Heat from the home or other structure being cooled is the low temperature heat source for low temperature heat transfer loop 30, and this heat causes refrigerant 390 (R502) to act with positive compressive action upon the refrigerants 190 and 290 within the two high temperature chambers 125,226 of compressors 120,220.

The heat acquired by evaporator 100 from some heat source which serves as the high temperature heat source for high temperature heat loop 10 causes refrigerant 190 (R114) to act with positive compressive action upon refrigerant 390 (R502) within chamber 126 of compressor 120 in the other of the two possible compressive action directions. When this compressive action is complete, the heat which powered this action is transferred from refrigerant 190 (R114) in condenser 150 to refrigerant 290 (R12) which surrounds condenser 150, both being contained within evaporator 200. This transfer of heat occurs at a temperature below 153° F., at which temperature refrigerant 190 (R114) will condense at a pressure of 99.99 PSIA, and above a temperature of 122° F., at which temperature refrigerant 290 will boil at a pressure of 176.85 PSIA. The lower the temperature in condenser 150 at which refrigerant 190 (R114) condenses, the lower the vapor pressure of refrigerant 190 (R114) will be and consequently the faster refrigerant 390 (R502) will push the refrigerant 190 (R114) out of chamber 125 compressor 120. The cycle time for compressor 120 will therefore vary inversely with the temperature at which refrigerant 190 (R114) condenses in condenser 150. The opposite is true for the cycle time for compressor 220. The higher the temperature in evaporator 200 at which refrigerant 290 (R12) boils, the higher the vapor pressure of refrigerant 290 (R12) and consequently the faster refrigerant 290 (R12) will push refrigerant 390 (R502) out of chamber 227 of compressor 220. These relationships act as a self regulating mechanism to synchronize the operation of the two compressors; i.e., while refrigerant 390 is being forced out of one compressor it is forcing out the refrigerant of the high temperature loop of the other.

The transfer of heat from refrigerant 190 (R114) to refrigerant 290 (R12) and the sequential displacement of refrigerant 390 (R502) from compressors 120 and 220 which occurs as a result of this heat transfer results in greater thermal efficiency than is possible if heat from high temperature heat source, 100 is used only once as described in U.S. Pat. No. 4,418,547 issued Dec. 6, 1983. To illustrate on a theoretical basis, if refrigerant 190 (R114) is used alone to effect the cooling of a structure with refrigerant 390 (R502) being the second refrigerant, and if the evaporation temperature of refrigerant 190 (R114) in evaporator 100 is 200° F. and its condensing temperature is 140° F., and if the evaporation temperature of refrigerant 390 in evaporator 300 is 43° F. and its condensing temperature is 80° F., each BTU of heat input into evaporator 100 would effect the removal of 0.38 BTU from the structure being cooled. Likewise, if refrigerant 290 (R12) is used alone to effect the cooling of a structure with refrigerant 390 (R502) being the second refrigerant, and if the evaporation temperature of the refrigerant 290 (R12) is 140° F., each BTU of heat input on the high temperature side of the system would effect the removal of 0.34 BTU from the low temperature side. With sequential displacement, however, using two compressors each BTU of heat input on the high temperside effects the removal of 0.72 BTU from the low temperature side of the system. The improvement in thermal efficiency that results from the use of sequential displacement is quite evident. A system utilizing sequential displacement may be composed of more than two compressors and more than two high temp closed heat transfer loops (on the high temperature side of the system) with only a single closed heat transfer loop and a single heat source comprising the low temperature side of the system. It should be noted that the temperatures of the heat sources for heat transfer loops 10 and 20 are higher than that of heat transfer loop 30. This is the basis for naming them high temperature loops and the chambers 125 and 226 of compressors 120 and 220 as high temperature chambers, and loop 30 as a low temperature loop and chambers 126 and 227 as low temperature chambers.

Figure 2:
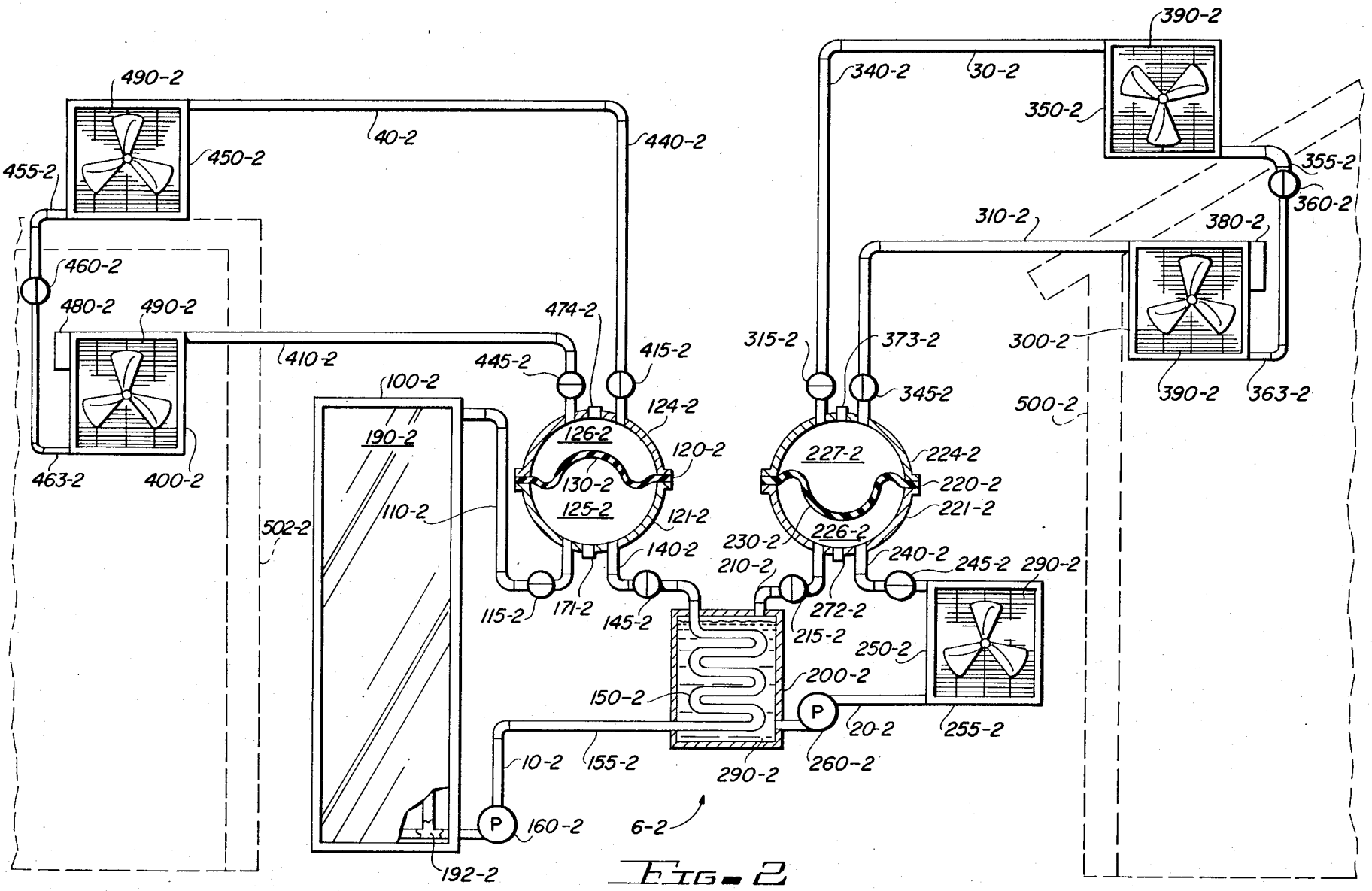
FIG. 2 is a schematic view of another embodiment of the thermally powered heat transfer system employed to remove heat from two structures or from two areas of the same structure embodying this invention and employing sequential displacement.

The thermally powered heat transfer system 6-2 depicted in FIG. 2 is designed to cool two different homes or structures using sequential displacement of the energy from a single high temperature heat source. Thus the thermally powered heat transfer system 6-2 depicted in FIG. 2 has two low temperature heat sources which may or may not have similar temperatures in terms of desired design temperatures within the separate structures. The thermally powered heat transfer system 6-2 depicted in FIG. 2 consists of four closed heat transfer loops, two high temperature loops 10-2 and 20-2 and two low temperature loops 30-2 and 40-2, each of which contains a different refrigerant in both liquid and vapor states.

Closed heat transfer loop 10-2 of system 6-2 may be substantially identical to closed heat transfer loop 10 of system 5 in FIG. 1.

Closed heat transfer loop 20-2 of system 6-2 may be substantially identical to closed heat transfer loop 20 of system 5 in FIG. 1.

Closed heat transfer loop 30-2 of system 6-2 depicted in FIG. 2 differs from closed heat transfer loop 30 of system 5 in FIG. 1. Closed heat transfer loop 30-2 of system 6-2 includes only the upper low temperature chamber 227-2 of compressor 220-2. Thus the top of evaporator 300-2, which is located within structure 500-2 to be cooled, is connected by means of refrigerant vapor pipe 310-2 to the upper, or low temperature chamber 227-2 of compressor 220-2, vapor flow from the evaporator 300-2 to chamber 227-2 of compressor 220-2 being regulated by electrically activated valve 345-2. Chamber 227-2 of compressor 220-2 is connected to the top of condenser 350-2 by means of refrigerant vapor pipe 340-2, vapor flow from chamber 227-2 of compressor 220-2 being regulated by electrically activated valve 315-2. Condenser 350-2 is depicted as using fan driven external ambient air as the heat sink for closed loop 30-2. The bottom of condenser 350-2 is connected to the bottom of evaporator 300-2 by means of refrigerant liquid pipe 355-2 and refrigerant liquid tube 363-2. Liquid refrigerant flow from condenser 350-2 to evaporator 300-2 is regulated by electrically activated valve 360-2. Evaporator 300-2, a portion of condenser 350-2, refrigerant liquid pipe 355-2 and refrigerant liquid tube 363-2 are filled with liquid refrigerant 390-2, the balance of closed 30-2 being filled with refrigerant 390-2 vapor.

Closed low temperature heat transfer loop 40-2 of system 6-2 depicted in FIG. 2 consists of evaporator 400-2 which is located within a second structure 502-2 to be cooled and which is depicted in FIG. 2 as using fan driven air from structure 502-2 as the heat source for closed loop 40-2. The top of evaporator 400-2 is connected by means of refrigerant vapor pipe 410-2 to the upper,low temperature chamber 126-2 of compressor 120-2, vapor flow from evaporator 400-2 to chamber 126-2 of compressor 120-2 being regulated by electrically activated valve 445-2. Chamber 126-2 of compressor 120-2 is connected to the top of condenser 450-2 by means of refrigerant vapor pipe 440-2, vapor flow from chamber 126-2 of compressor 120-2 being regulated by electrically activated valve 415-2. Condenser 450-2 is depicted as using fan driven external ambient air as the heat sink for closed loop 40-2. The bottom of condenser 450-2 is connected to the bottom of evaporator 400-2 by means of refrigerant liquid pipe 455-2 and refrigerant liquid tube 463-2. Liquid refrigerant flow from condenser 450-2 to evaporator 400-2 is regulated by electrically activated valve 460-2. Evaporator 400-2, a portion of condenser 450-2, refrigerant liquid pipe 455-2 and refrigerant liquid tube 463-2 are filled with liquid refrigerant 490-2, the balance of closed loop 40-2 being filled with refrigerant 490-2 vapor.

Switch 171-2 is located at the bottom of compressor 120-2 and switch 171-2 is activated when diaphragm 130-2 is forced by vapor pressure against rigid hemisphere 121-2. When activated switch 171-2 causes electrically activated valves 115-2 and 415-2 to open and electrically activated valves 145-2 and 445-2 to close. Switch 474-2 is located at thetop of compressor 120-2 and switch 474-2 is activated when diaphragm 130-2 is forced by vapor pressure against rigid hemisphere 124-2. When activated switch 474-2 causes electrically activated valves 115-2 and 415-2 to close and electrically activated valves 145-2 and 445-2 to open. Switch 474-2 also activates pump 160-2, said pump being deactivated when switch 171-2 is activated.

Switch 272-2 is located at the bottom of compressor 220-2 and switch 272-2 is activated when diaphragm 230-2 is forced by vapor pressure against rigid hemisphere 221-2. When activated, switch 272-2 causes valves 215-2 and 315-2 to open and valves 245-2 and 345-2 to close. Switch 373-2 is located at the top of compressor 220-2 and switch 373-2 is activated when diaphragm 230-2 is forced by vapor pressure against rigid hemisphere 224-2. When activated switch 373-2 causes valves 215-2 and 315-2 to close and valves 245-2 and 345-2 to open. Switch 373-2 also activates pump 260-2, said pump being deactivated when switch 272-2 is activated.

Switch 380-2 is a liquid level control switch which monitors the level of liquid refrigerant 390-2 in evaporator 300-2. When the liquid level of refrigerant 390-2 in evaporator 300-2 falls below a minimum level, switch 380-2 causes electrically activated valve 360-2 to open. When the level of liquid refrigerant 390-2 in evaporator 300-2 reaches a desired maximum level, switch 380-2 causes valve 360-2 to close.

Switch 480-2 is a liquid level control switch which monitors the level of liquid refrigerant 490-2 in evaporator 400-2. When the liquid level of refrigerant 490-2 in evaporator 400-2 falls below a minimum level, switch 480-2 causes electrically activated valve 460-2 to open. When the level of liquid refrigerant 490-2 in evaporator 400-2 reaches a desired maximum level, switch 480-2 causes valve 460-2 to close.

Refrigerant 190-2 is selected so that its vapor pressure in evaporator 100-2 at operating temperature is greater than the vapor pressure of refrigerant 490-2 in condenser 450-2 and also so that the vapor pressure of refrigerant 190-2 in condenser 150-2 is less than the vapor pressure of refrigerant 490-2 in evaporator 400-2.

Refrigerant 290-2 is selected so that its vapor pressure in evaporator 200-2 is greater than the vapor pressure of refrigerant 390-2 in condenser 350-2 and also so that refrigerant 290-2's vapor pressure in condenser 250-2 is less than the vapor pressure of refrigerant 390-2 in evaporator 300-2.

All four refrigerants are selected so as to have the above cited relationships and so as to meet overall system performance criteria for the cooling of different structures.

To illustrate the operation of thermally powered heat transfer system 6-2 depicted in FIG. 2 let us now assume that the refrigerant 190-2 is refrigerant R11,CC1F, that the refrigerant 490 is refrigerant R22,$CHC1F_2$, that the refrigerant 290-2 is refrigerant R12, and the the refrigerant 390-2 is refrigerant R502. Let us also assume the internal condensing temperature within condensers 250-2, 350-2, and 450-2 all of which use external air as the heat sink, is 80° F. At a temperature of 240° F., now assumed to be the internal temperature of evaporator 100-2, refrigerant 190-2 (R11) has a vapor pressure of 163.35 PSIA which is a higher pressure than the pressure (158.33 PSIA) of refrigerant 490-2 (R22) in condenser 450-2 at 80° F. At a temperature of 10° F., now assumed to be the internal temperature of evaporator 400-2, refrigerant 490-2 (R22) has a vapor pressure of 47.46 PSIA which is a higher pressure than the pressure (38.67 PSIA) of refrigerant 190-2 (R11) in condenser 150-2 at the now assumed temperature of 130° F. At a temperature of 130° F., now assumed to be the internal temperature of evaporator 200-2, refrigerant 290-2 (R12) has a vapor pressure of 195.71 PSIA which is a higher pressure than the pressure (175.92 PSIA) of refrigerant 390-2 (R502) in condenser 350-2 at 80° F. At a temperature of 45° F., now assumed to be the internal temperature in evaporator 300-2, refrigerant 390-2 (R502) has a vapor pressure of 103.42 PSIA which is a higher pressure than the pressure (98.87 PSIA) of refrigerant 290-2 (R12) in condenser 250-2 at 80° F.

Given these characteristics of the four refrigerants it is readily apparent that the operation of thermally powered heat transfer system 6-2 depicted in FIG. 2 is similar to the operation of thermally powered heat transfer system 5 depicted in FIG. 1. The addition of the fourth closed heat transfer loop, in conjunction with the change in the refrigerants, permits the thermally powered heat transfer system 6-2 to cool two different structures to two different temperatures using a single high temperature source of heat. The same results could be obtained by utilizing two single compressor systems with two high temperature heat sources as described in U.S. Pat. No. 4,418,547 but sequential displacement permits these results to be obtained at higher thermal efficienty.

The detailed description of the operation of thermally powered heat transfer system 6-2 utilizing sequential displacement as depicted in FIG. 2 is as follows:

Heat input into evaporator 100-2 causes refrigerant 190-2 (R11) to boil and vapor pressure causes refrigerant 190-2 (R11) vapor to flow through vapor pipe 110-2 and open valve 115-2 into high temperature chamber 125-2 of compressor 120-2. The pressure exerted by refrigerant 190-2 (R11) will push diaphragm 130-2 and thereby cause diaphragm 130-2 to force refrigerant 490-2 (R22) vapor out of low temperature chamber 126-2 of compressor 120-2 through vapor pipe 440-2 and open valve 415-2 into condenser 450-2 where it will condense. When refrigerant 190-2 (R11) fills chamber 125-2 of compressor 120-2 diaphragm 130-2 will press against the inner surface of rigid hemisphere 124-2 and will activate switch 474-2. Switch 474-2 will cause valves 115-2 and 415-2 to close and previously closed valves 145-2 and 445-2 to open and will activate pump 160-2.

Heat input into evaporator 400-2 causes refrigerant 490-2 (R22) to boil and vapor pressure causes refrigerant 490-2 (R22) vapor to flow through vapor pipe 410-2 and open valve 445-2 into chamber 126-2 of compressor 120-2. The pressure exerted by refrigerant 490-2(R22) will push diaphragm 130-2 and thereby cause diaphragm 130-2 to force refrigerant 190-2 (R11) vapor out of chamber 125-2 of compressor 120-2 through vapor pipe 140-2 and open valve 145-2 into condenser 150-2 where it will condense. Liquid refrigerant 190-2 (R11) will flow into liquid pipe 155-2 and will be pumped by pump 160-2 back into evaporator 100-2. When refrigerant 490-2 (R22) vapor fills the upper chamber of compressor 120-2 diaphragm 130-2 will press against the inner surface of rigid hemisphere 121-2 and will activate switch 171-2. Switch 171-2 will cause valves 115-2 and 415-2 to open and and valves 145-2 and 445-2 to close and will deactivate pump 160-2.

Whenever the liquid level of refrigerant 490-2 (R22) in evaporator 400-2 falls below a given minimum level, switch 480-2 causes valve 460-2 to open thereby permitting liquid refrigerant 490-2 (R22) to flow from condenser 450-2 through liquid pipe 455-2, valve 460-2 and liquid tube 463-2 into evaporator 400-2. When the liquid level of refrigerant 490-2 (R22) in evaporator 400-2 rises to a given maximum level, switch 480-2 causes valve 460-2 to close.

The stage is now set for a repeat of this cycle.

Heat input into evaporator 200-2 from condenser 150-2 causes refrigerant 290(R12) to boil and vapor pressure causes refrigerant 290-2(R12) vapor to flow through vapor pipe 210-2 and open valve 215-2 into the lower high temperature chamber 226-2 of compressor 220-2. The pressure exerted by refrigerant 290-2 (R12) vapor will push diaphragm 230-2 and therby force refrigerant 390-2(R502) vapor out of upper, low temperature chamber 227-2 of compressor 220-2 through vapor pipe 340-2 and open valve 315-2 into condenser 350-2 where it will condense. When refrigerant 290-2 (R12) fills chamber 226-2 of compressor 220-2 diaphragm 230-2 will press against the inner surface of rigid hemisphere 224-2 and will activate switch 373-2. Switch 373-2 will cause valves 215-2 and 315-2 to close and previously closed valves 245-2 and 345-2 to open and will activate pump 260-2.

Heat input into evaporator 300-2 causes refrigerant 390-2(R502) to boil and vapor pressure causes refrigerant 390-2 (R502) vapor to flow through open valve 345-2 and vapor pipe 310-2 into low temperature chamber 227-2 of compressor 220-2. The pressure exerted by refrigerant 390-2 (R502) vapor will push diaphragm 230-2 and thereby cause diaphragm 230-2 to force refrigerant 290-2 (R12) vapor out of chamber 226-2 of compressor 220-2 through vapor pipe 240-2 and open valve 245-2 into condenser 250-2 where it will condense. Liquid refrigerant 290-2 (R12) will flow into liquid pipe 255-2 and will be pumped by pump 260-2 into evaporator 200-2. When refrigerant 390-2 (R502) vapor fills chamber 227-2 of compressor 220-2 diaphragm 230-2 will press against the inner surface of rigid hemisphere 221-2 and will activate switch 272-2. Switch 272-2 will cause valves 215-2 and 315-2 to open and valves 245-2 and 345-2 to close and will deactivate pump 260-2.

Whenever the liquid level of refrigerant 390-2 (R502) in evaporator 300-2 falls below a given minimum level, switch 380-2 causes valve 360-2 to open thereby permitting liquid refrigerant 390-2 (R502) to flow from condenser 350-2 through liquid pipe 355-2, valve 360-2 and liquid tube 363-2 into evaporator 300. When the liquid level of refrigerant 390-2 (R502) in evaporator 300-2 rises to a given maximum level, switch 380-2 causes valve 360-2 to close.

The stage is now set for a repeat of this cycle.

The thermally powered heat transfer system 6-2 utilizing sequential displacement as depicted in FIG. 2 is thus capable of being operated for dual purposes involving different temperatures with a single external high temperature heat source and two separate low temperature heat sources. The system 6-2 depicted in FIG. 2 is composed of two closed heat transfer loops on the high temperature side of two compressor and two closed heat transfer loops on the low temperature side of the two compressors, but additional dual acting compressors could be added together with associated high and low temperature heat transfer loops without departing from the spirit of this invention as defined by the scope of the claims.

Figure 3:
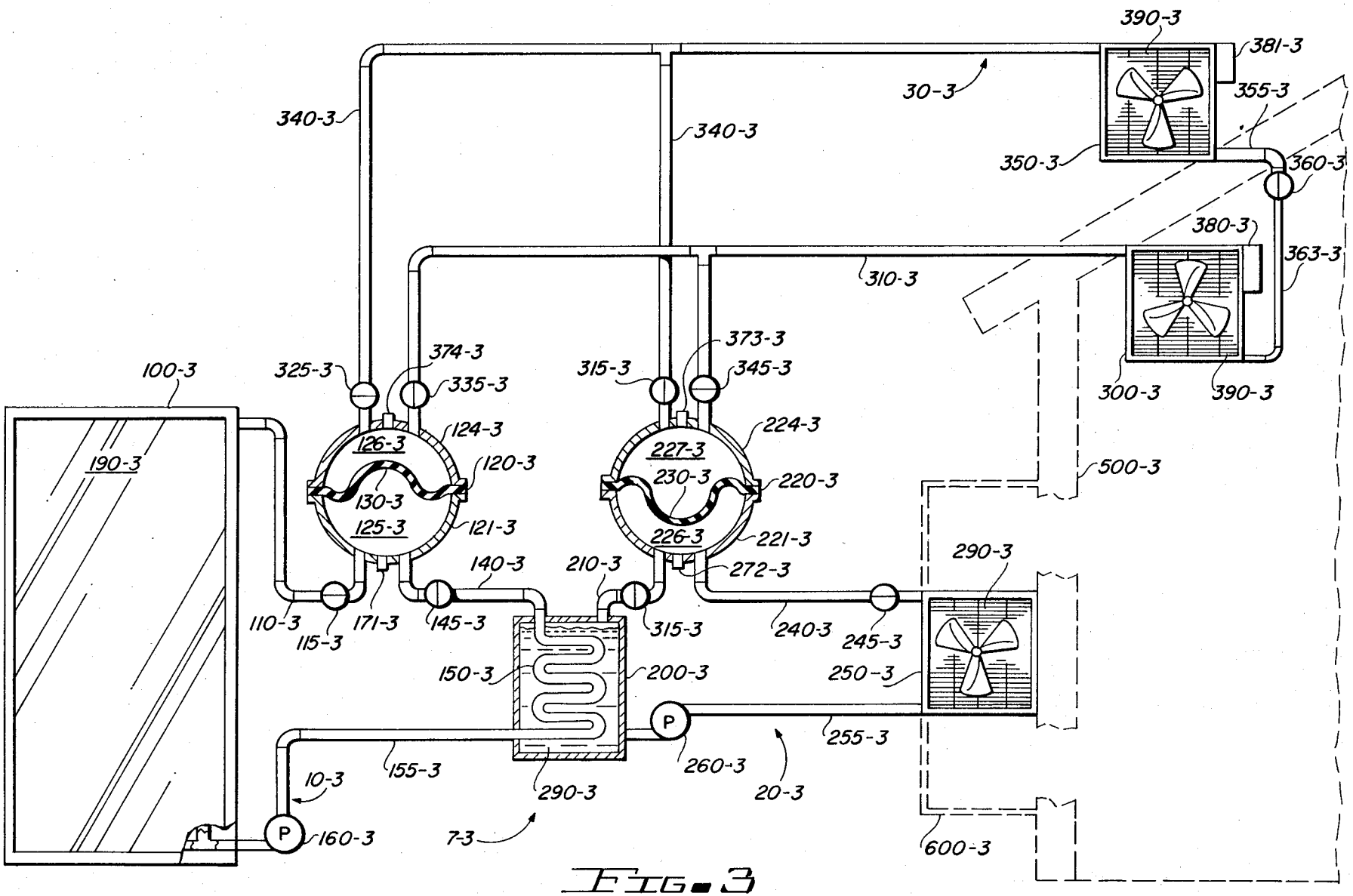
FIG. 3 is a schematic view of a preferred embodiment of the thermally powered heat transfer system designed to remove heat from a single structure during the summer and to supply heat to a single structure during the winter and herein employed to accomplish the latter embodying this invention and employing sequential displacement.

The thermally powered heat transfer system 7-3 utilizing sequential displacement depicted in FIG. 3 can be operated as an air conditioning system for cooling during the summer and as a heat pump system for heating during the winter. The thermally powered heat transfer system 7-3 utilizing sequential displacement depicted in FIG. 3 incorporates all of the components of the thermally powered heat transfer system 5 utilizing sequential displacement depicted in FIG. 1. When the thermally powered heat transfer system 7-3 is operated as an air conditioning system for cooling during the summer it operates in a manner identical to the operation of the thermally powered heat transfer system 5 as previously described. Several additions to the thermally powered heat transfer system 5 are necessary to permit system 7-3 to operate as a heat pump for heating during the winter and these additions are illustrated in FIG. 3.

Thermally powered heat transfer system 7-3 depicted in FIG. 3 consists of three closed heat transfer loops, 10-3, 20-3, and 30-3, each of which contains a different refrigerant in both liquid and vapor states. Closed heat transfer loop 10-3 of system 7-3 is substantially identical in all respects to closed heat transfer loop 10 of system 5. Condenser 250-3 of closed heat transfer loop 20-3 of system 7-3 is,in system 7-3, enclosed in duct work (600-3) which permits air from the structure 500-3 being heated to be circulated through condenser 250-3 and returned to structure 500-3. In all other respects closed heat transfer loop 20-3 of system 7-3 depicted in FIG. 3 is identical to closed heat transfer loop 20 system 5 depicted in FIG. 1. Liquid level control switch 381-3 has been added to heat exchanger 350-3 of heat transfer loop 30-3 of system 7-3 as depicted in FIG. 3. Liquid level control switch 380-3 remains on heat exchanger 300-3 but serves no purpose when system 7-3 is used as a heat pump for the heating of a structure and therefore liquid level control switch 380-3 would simply be rendered inoperable electrically when system 7-3 is used for heating. The functions of heat exchanger 300-3 and 350-3 of system 7-3 are reversed compared to the functions of heat exchangers 300 and 350 of system 5, but this change in function does not entail any physical change involving these units. Thus, except for the addition of liquid level control switch 381-3 to heat exchanger 350-3, closed heat transfer loop 30-3 of thermally powered heat transfer system 7-3 as depicted in FIG. 3 is the physical equivalent of closed heat transfer loop 30-3 of thermally powered heat transfer system 5 as depicted in FIG. 1.

When used for heating, a separate control circuit governs the opening and closing of the electrically activated valves of system 7-3. In the heating mode, when switch 171-3 is activated by diaphragm 130-3, switch 171-3 causes electrically activated valves 115-3 and 335-3 to open and valves 145-3 and 325-3 to close. When switch 374-3 is activated by diaphragm 130-3, switch 374-3 causes electrically activated valves 115-3 and 335-3 to close and valves 145-3 and 325-3 to open. Switch 374-3 also activates pump 160-3, said pump being deactivated when switch 171-3 is is activated. When switch 272-3 is activated by diaphragm 230-3, switch 272-3 causes electrically activated valves 215-3 and 345-3 to open and valves 245-3 and 315-3 to close. When switch 373-3 is activated by diaphragm 230-3, switch 373-3 causes electrically activated valves 215-3 and 345-3 to close and valves 245-3 and 315-3 to open. Switch 373-3 also activates pump 260-3, said pump being deactivated when switch 272-3 is activated.

Operation of the thermally powered heat transfer system 7-3 utilizing sequential displacement as depicted in FIG. 3 as a heat pump for heating a structure starts when heat input into evaporator 100-3 causes refrigerant 190-3 (R114) to boil and vapor pressure causes refrigerant 190-3 (R114) vapor to flow through vapor pipe 110-3 and open valve 115-3 into the lower high temperature chamber 125-3 of compressor 120-3. The pressure exerted by refrigerant 190-3(R114) will push diaphragm 130-3 and thereby cause diaphragm 130-3 to force refrigerant 390-3(R502) vapor out of the upper low temperature chamber 126-3 of compressor 120-3 through vapor pipe 310-3 and open valve 335-3 into heat exchanger-condenser 300-3 where it will condense giving up its heat to circulating air from structure 500-3 being heated. When refrigerant 190-3 (R114) fills the lower chamber of compressor 120-3, diaphragm 130-3 will press against the inner surface of rigid hemisphere 124-3 and will activate switch 374-3. Switch 374-3 will cause valves 115-3 and 335-3 to close and previously closed valves 145-3 and 325-3 to open and will activate pump 160-3.

Heat input into heat exchanger-evaporator 350-3, said heat being acquired from external air circulating through heat exchanger-evaporator 350-3, causes refrigerant 390-3(R502) to boil and vapor pressure causes refrigerant 390-3 (R502) vapor to flow through vapor pipe 340-3 and open valve 325-3 into chamber 126-3 of compressor 120-3. The pressure exerted by refrigerant 390-3(R502) will push diaphragm 130-3 and thereby cause diaphragm 130-3 to force refrigerant 190-3(R114) vapor out chamber 125-3 of compressor 120-3 through vapor pipe 140-3 and open valve 145-3 into condenser 150-3 where it will condense. Liquid refrigerant 190-3(R114) will flow into liquid pipe 155-3 and will be pumped by pump 160-3 back into evaporator 100-3. When refrigerant 390-3 (R502) vapor fills chamber 126-3 of compressor 120-3 diaphragm 130-3 will press against the inner surface of rigid hemisphere 121-3 and will activate switch 171-3. Switch 171-3 will cause valves 115-3 and 335-3 to open, will cause valves 145-3 and 325-3 to close, and will deactivate pump 160-3.

Whenever the liquid level of refrigerant 390-3 (R502) in heat exchanger-evaporator 350 falls below a given minimum level, liquid level control switch 381-3 causes electrically activated valve 360-3 to open thereby permitting liquid refrigerant 390-3(R502) to flow from heat exchanger-condenser 300-3 through liquid tube 363-3, open valve 360-3 and liquid pipe 355-3 into heat exchanger-evaporator 350-3. When the liquid level of refrigerant 390-3 (R502) in heat exchanger-evaporator 350-3 rises to a given maximum level, switch 381-3 causes valve 360-3 to close.

The stage is now set for a repeat of this cycle.

Heat input into evaporator 200-3 from condenser 150-3 causes refrigerant 290-3 (R12) to boil and vapor pressure causes refrigerant 290-3 (R12) vapor to flow through vapor pipe 210-3 and open valve 215-3 into the lower,high temperature chamber 226-3 of compressor 220-3. The pressure exerted by refrigerant 290-3 (R12) vapor will push diaphragm 230-3 and thereby cause diaphram 230-3 to force refrigerant 390-3 (R502) vapor out of the upper,low temperature chamber 227-3 of compressor 220-3 through vapor pipe 310-3 and open valve 345-3 into heat exchanger-condenser 300-3 where it will condense giving up its heat to circulating air from structure 500-3 being heated. When refrigerant 290-3 (R12) fills chamber 226-3 of compressor 220-3 diaphragm 230-3 will press against the inner surface of rigid hemisphere 224-3 and will activate switch 373-3. Switch 373-3 will cause valves 215-3 and 345-3 to close and previously closed valves 245-3 and 315-3 to open and will activate pump 260-3.

Heat input into heat exchanger-evaporator 350-3, said heat being acquired from external air circulating through heat exchanger-evaporator 350-3, causes refrigerant 390-3 (R502) to boil and vapor pressure causes refrigerant 390-3 (R502) vapor to flow through vapor pipe 340-3 and open valve 315-3 into the upper chamber of compressor 220-3. The pressure exerted by refrigerant 90-3(R502) will cause diaphragm 230-3 to force refrigerant 90-3 (R12) from chamber 226-3 through vapor pipe 240-3 and open valve 245-3 into condenser 250-3 where it will condense, giving up its heat to circulating air from the structure 500-3 moving through duct 600-3. Liquid refrigerant 290-3 (R12) will flow into liquid pipe 255-3 and will be pumped by pump 260-3 back into evaporator 200-3. When refrigerant 390-3(R502) vapor fills the chamber 227-3 of compressor 220-3 diaphragm 230-3 will press against the inner surface of rigid hemisphere 221-3 and will activate switch 272-3. Switch 272-3 will cause valves 215-3 and 345-3 to open, will cause valves 245-3 and 315-3 to close, and will deactivate pump 260-3.

The stage is now set for a repeat of this cycle.

When the thermally powered heat transfer system 7-3 utilizing sequential displacement as depicted in FIG. 3 is used as a heat pump for heating a structure, the heat from the fuel or other energy source is used to heat that structure and this heat is supplemented by heat acquired from external air or from some otherwise not useful low temperature heat source.

What is claimed is:

1. A thermally powered heat transfer system comprising:

a plurality of compressors, each compressor including a high temperature and a low temperature chamber with movable divider means separating the two chambers;

a higher temperature heat transfer loop for each compressor each high temperature heat transfer loop including a refrigerant, an evaporator, a source of heat for the evaporator, a condenser, a heat sink for the condenser, a high temperature chamber of a compressor and means for controlling flow of the the refrigerant through higher temperature heat transfer loops, the condensers of all the high temperature heat transfer loops, except one being the source of heat for all the higher temperature heat transfer loops except one;

a lower temperature heat transfer loop for each compressor including a refrigerant, an evaporator, a source of heat for the evaporator, a condenser, a heat sink for the condenser, a low temperature chamber of a compressor and means for controlling the flow of the refrigerant of the lower temperature heat transfer loop; and control means for the means for controlling of each loop of the system.

2. The thermally powered heat transfer system of claim 1 in which the lower temperature heat transfer loop includes the low temperature chambers of each compressor.

3. The thermally powered heat transfer system of claim 2 in which the functions of the evaporator and condenser of the lower temperature heat transfer loop are interchangeable.

4. The thermally powered heat transfer system of claim 3 in which the number of compressors is two.

5. A thermally powered heat transfer system comprising:

two compressors each compressor including a high temperature and a low temperature chamber with a flexible movable diaphragm separating the two chambers;

a high temperature heat transfer loop for each compressor, each high temperature heat transfer loop including a refrigerant, an evaporator, a source of heat for the evaporator, a condenser, a heat sink for the condenser, a high temperature chamber of a compressor, and valve means for controlling flow of the refrigerant through the loop, the condenser of one of the high temperature loops being the source of heat for the evaporator of the other;

a low temperature heat transfer loop for each compressor; a low temperature heat transfer loop including a refrigerant, an evaporator, a source of heat for the evaporator, a condenser, a heat sink for the condenser, a low temperature chamber of a compressor, and valve means for controlling the flow of the refrigerant through the low temperature loop; and control means for controlling the valve means of the heat transfer loops of the system.

6. The thermally powered heat transfer system of claim 5 in which the low temperature heat transfer loop includes the low temperature chambers of the two compressors.

7. The thermally powered heat transfer system of claim 6 in which the evaporator and condenser of the low temperature heat transfer loop are interchangeable.

8. The thermally powered heat transfer system of claim 7 in which heat from the condenser of other high temperature loop is used as a source of heat for heating a structure.

9. The thermally powered heat transfer system of claim 5 in which the number of low temperature heat transfer loops is two.

10. A thermally powered heat transfer system comprising:

a first and a second compressor, each compressor being divided by a flexible diaphragm into a high temperature and a low temperature chamber;

a first and a second high temperature heat transfer loop, each such loop including a refrigerant, an evaporator, a source of heat for the evaporator, a condenser, a heat sink for for the condenser, a high temperature chamber of a compressor, and a means for controlling the flow of refrigerant through the loop, the first high temperature loop including the high temperature chamber of the first compressor and the second high temperature loop including the high temperature chamber of the second compressor, the condenser of the first high temperature loop and evaporator of the second higher temperature loop being combined so that the refrigerant of the second high temperature loop is the heat sink for the condenser of the first high temperature loop;

a third low temperature heat transfer loop including a refrigerant, an evaporator, a source of heat for the evaporator, a condensor, a heat sink for the condenser, the low temperature chambers of the compressors, and means for controlling the flow of the refrigerant through the loop; and control means for controlling the means for controlling the flow of refrigerants in the heat transfer loops of the system.

11. The thermally powered heat transfer system of claim 10 in which the functions of the evaporator and condenser of the third loop are interchangeable.

12. The thermally powered heat transfer system of claim 11 in which heat from the condenser of the second high temperature loop is used to heat a structure when the system is used to heat said structure.

13. A thermally powered heat transfer system comprising:

a first and a second compressor, each compressor being divided by a flexible diaphragm into a high temperature and a low temperature chamber;

a first and a second high temperature heat transfer loop, each such loop including a refrigerant, an evaporator, a source of heat for the evaporator, a condenser, a heat sink for the condenser, a high temperature chamber of a compressor, and a means for controlling the flow of refrigerant through the loop, the first high temperature loop including the high temperature chamber of the first compressor and the second high temperature loop including the high temperature chamber of the second compressor, the condenser of the first high temperature loop and evaporator of the second high temperature loop being combined so that the refrigerant of the second high temperature loop is the heat sink for the condenser of the first high temperature loop;

a third and a fourth low temperature heat transfer loop, each such loop including a refrigerant, an evaporator, a source of heat for the evaporator, a condenser, a heat sink for the condenser, a low temperature chamber of a compressor, and means for controlling the flow of refrigerant through the loop, the third low temperature loop including the low temperature chamber of the first compressor and the fourth low temperature loop including the low temperature chamber of the second compressor; and control means for controlling the means for controlling the flow of refrigerants in the heat transfer loops of the system.

14. The thermally powered heat transfer system of claim 13 in which the refrigerants of each heat transfer system are fluorinated hydrocarbons.

15. The thermally powered heat transfer system of claim 14 in which the flexible diaphragms of the compressors are fabricated of nylon coated with a flexible epoxy.

* * * * *